US007766688B2

(12) United States Patent
Mateo Ferrus et al.

(10) Patent No.: US 7,766,688 B2
(45) Date of Patent: Aug. 3, 2010

(54) CONNECTOR

(75) Inventors: Rafael Mateo Ferrus, Barcelona (ES); Josep Sanabra Jansa, Vilanova I Geltru (ES); Antoni Puell Olle, Barcelona (ES)

(73) Assignee: Tyco Electronics AMP Espana SA, Barcelona (ES)

( * ) Notice: Subject to any disclaimer, the term of this patent is extended or adjusted under 35 U.S.C. 154(b) by 0 days.

(21) Appl. No.: 12/514,489

(22) PCT Filed: Nov. 2, 2007

(86) PCT No.: PCT/GB2007/004193

§ 371 (c)(1), (2), (4) Date: May 12, 2009

(87) PCT Pub. No.: WO2008/059203

PCT Pub. Date: May 22, 2008

(65) Prior Publication Data

US 2010/0029122 A1 Feb. 4, 2010

(30) Foreign Application Priority Data

Nov. 13, 2006 (GB) ..... 0622461.2

(51) Int. Cl.
*H01R 4/24* (2006.01)

(52) U.S. Cl. ..... 439/417; 439/392

(58) Field of Classification Search ..... 439/392, 439/409, 417
See application file for complete search history.

(56) References Cited

U.S. PATENT DOCUMENTS 5,664,963 A * 9/1997 Yamamoto et al. ..... 439/409
6,872,090 B2 * 3/2005 De Dios Martin ..... 439/417

* cited by examiner

*Primary Examiner*—Tho D Ta
(74) *Attorney, Agent, or Firm*—Baker & Daniels LLP

(57) ABSTRACT

A connector for terminating a communications cable is disclosed including a termination assembly (30) including a plurality of wire receiving contacts (32) for receiving wires (24) of a cable; a lacing fixture (22) with a number of wire receiving spaces (23) and which is used to guide the wires into engagement with the wire receiving contacts (32); and a cutting blade (34) having a cutting portion (35) and a body portion; wherein the termination assembly and lacing fixture are arranged such that, as they are assembled together, wires held in the lacing fixture are pushed past the cutting portion of the blade which cuts off excess wire, the cut wires are pushed beyond the body portion of the blade, and the wires are pushed into engagement with the wire receiving contacts.

15 Claims, 10 Drawing Sheets

CONNECTOR

TECHNICAL FIELD

This invention relates to a connector suitable for a telecommunications cable having a plurality of insulated wires.

SUMMARY OF THE INVENTION

In a first aspect the present invention provides a connector for terminating a communications cable including a termination assembly including a plurality of wire receiving contacts for receiving wires of a cable; a lacing fixture with a number of wire receiving spaces and which is used to guide the wires into engagement with the wire receiving contacts; and a cutting blade having a cutting portion and a body portion; wherein the termination assembly and lacing fixture are arranged such that, as they are assembled together, wires held in the lacing fixture are displaced past the cutting portion of the blade and into engagement with the wire receiving contacts, which blade extends transversely to the wires and which cuts off excess wire, characterised in that the body portion of the blade is located sufficiently in advance of wire-receiving contacts for the cut wires engaged with the contacts to be further displaced beyond the body portion of the blade.

After assembly the blade may serve to shield the wires inside the connector from external electromagnetic radiation.

The connector may further include a recess in the lacing fixture which receives the cutting portion of a cutting blade when the connector is assembled.

The connector may further includes a surface which is disposed at an angle to the cutting blade to assist in ejection of cut wire ends during the assembly of the connector.

The connector may be a jack.

The wire receiving contacts may be insulation displacing contacts.

The lacing fixture and termination assembly may each have metal bodies which overlap one another when assembled together.

The connector may include two cutting blades.

The blades may be disposed on opposite sides of the connector.

The connector may include an internal shielding arrangement which provides shielding between pairs of wires.

The connector may be arranged to terminate 1, 2 or 4 pairs of wires.

In a second aspect the present invention provides a cap for a connector according to the first aspect of the invention which includes a recess which can accommodate the cutting portion of a cutting blade.

The cap may include a surface which is disposed at an angle to assist in ejection of cut wire ends.

In a third aspect the present invention provides a termination assembly for use in a connector according to this invention, including the said plurality of wire receiving contacts for receiving wires of a communications cable, and the said cutting blade having a cutting portion and a body portion, wherein the termination assembly is arranged to be assembled with the said lacing fixture such that, as they are assembled together, wires held in the lacing fixture are displaced past the cutting portion of the blade and into engagement with the wire receiving contacts, which blade extends transversely to the wires and which cuts off excess wire, characterised in that the body portion of the blade is located sufficiently in advance of wire-receiving contacts for the cut wires engaged with the contacts to be further displaced beyond the body portion of the blade.

The termination assembly may include at least two cutting blades.

In a fourth aspect the present invention provides a cable terminated by a connector according to the first aspect of the invention.

The positioning of the cutting blades in advance of the wire-receiving contacts according to the present invention has the advantages of reducing the wire cutting and insertion forces, and of avoiding subsequent short-circuit contact of the cut ends of the wire conductors with the body of the blade.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Figure 1:
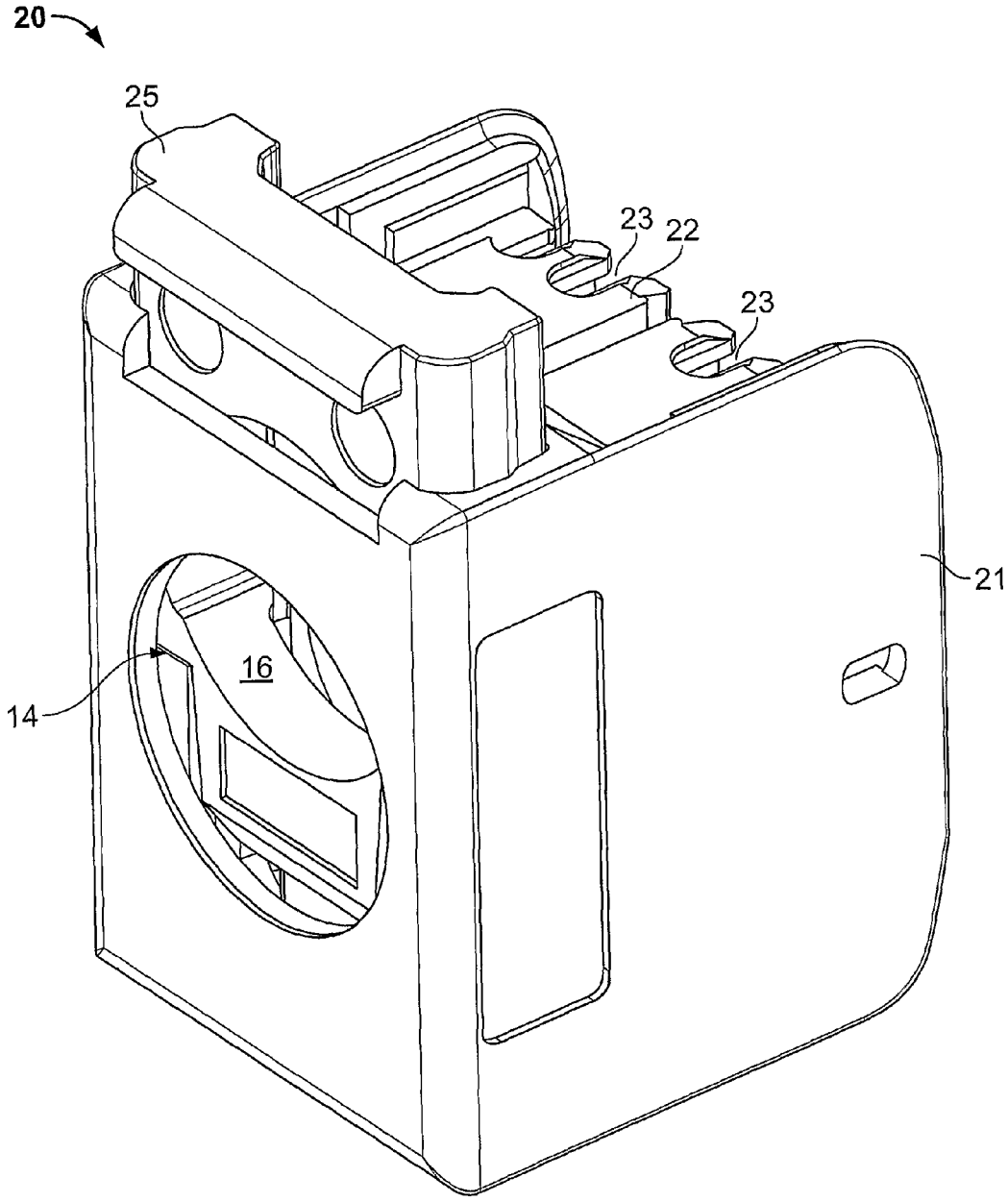
FIG. 1 is a perspective rear view of an embodiment of a cap for a connector according to the present invention.

Referring to FIG. 1 a cap 20 is shown which includes a cover 21 formed from Zamak or other metal or conductive material and preferably by a die-cast process. Cap 20 further includes a plastic lacing fixture 22 having a total of eight wire receiving spaces 23 to receive four pairs of wires. Cap 20 further includes a spring loaded wire clamp 25 which can move between an open position and a clamping position. In FIG. 1, clamp 25 is shown in the clamping position. Cap includes an aperture 14 which receives a cable to be terminated.

Figure 1A:
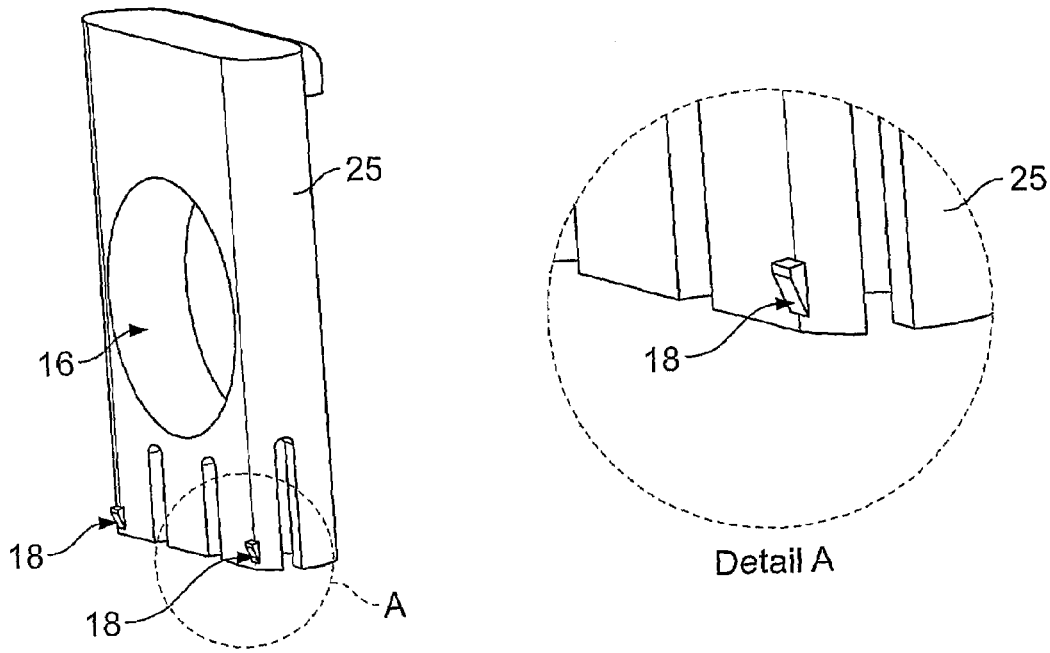
FIG. 1A is a perspective view of the cable clamp of FIG. 1.
Figure 1B:
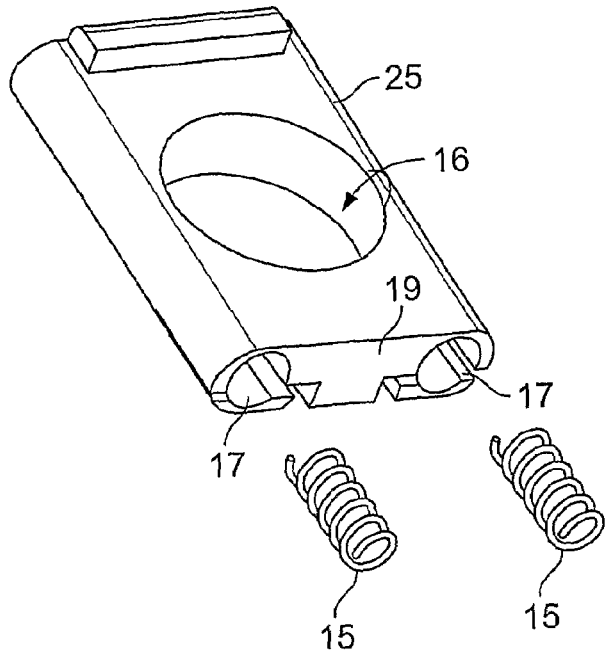
FIG. 1B is an alternative perspective view of the cable clamp of FIG. 1.

Referring to FIG. 1A, wire clamp 25 is shown in isolation and includes latches 18 which engage with recesses (not shown) inside cap to retain the latch in the free position or in the no wire inserted position. Referring to FIG. 1B, the lower surface 19 of clamp 25 includes recesses 17 which house compression springs 15. When installed in cover 21, springs 15 serve to bias the clamp 25 towards the clamping position. A cable is gripped by clamp 25 by being squeezed between the lower edge of recess 16 and the upper edge of recess 14 under force of compression springs 15. This type of cable clamp is also described in published patent specification WO2005/104300.

Figure 2:
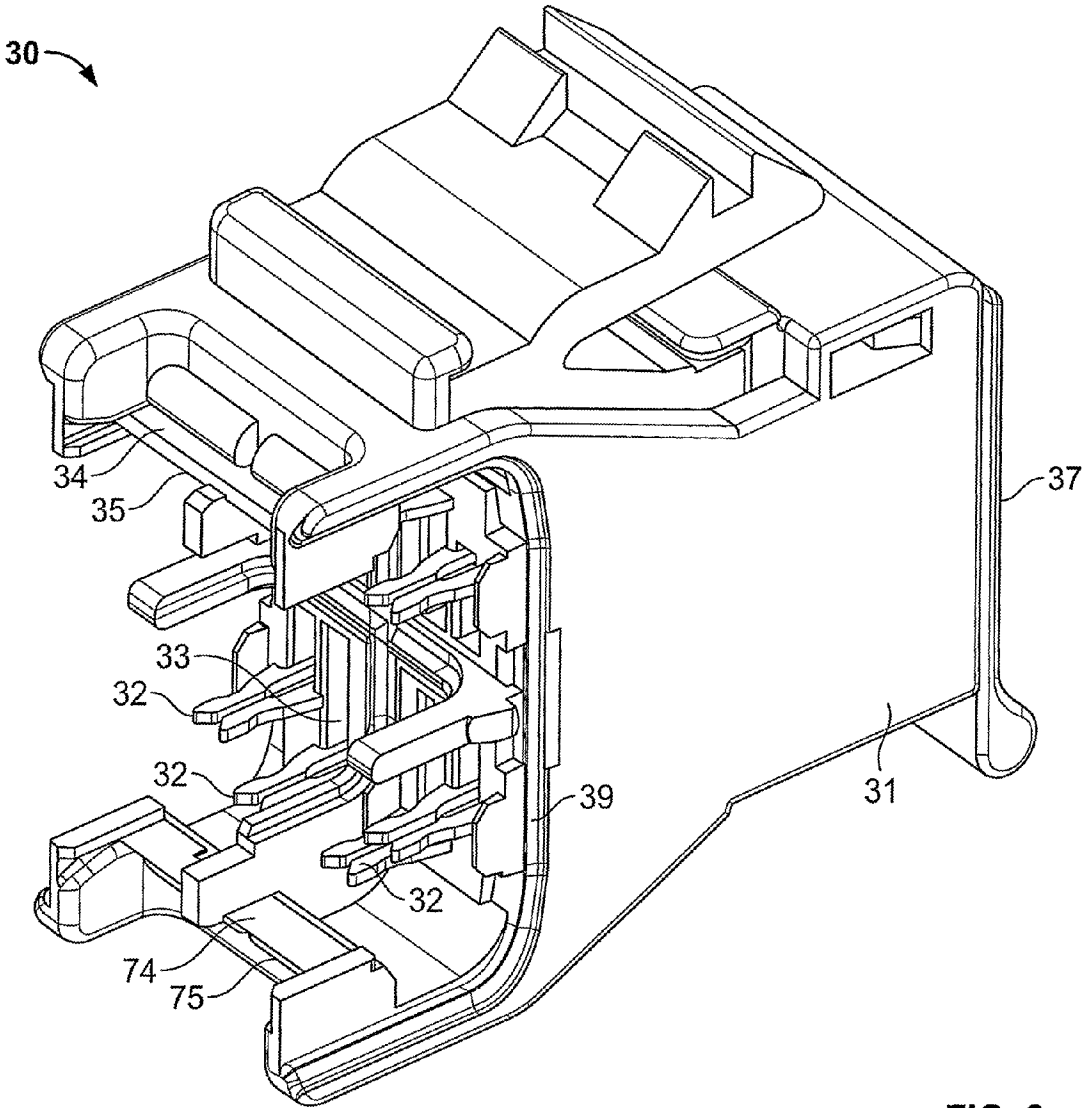
FIG. 2 is a perspective view of a housing for use with the cap of FIG. 1.
Figure 8:
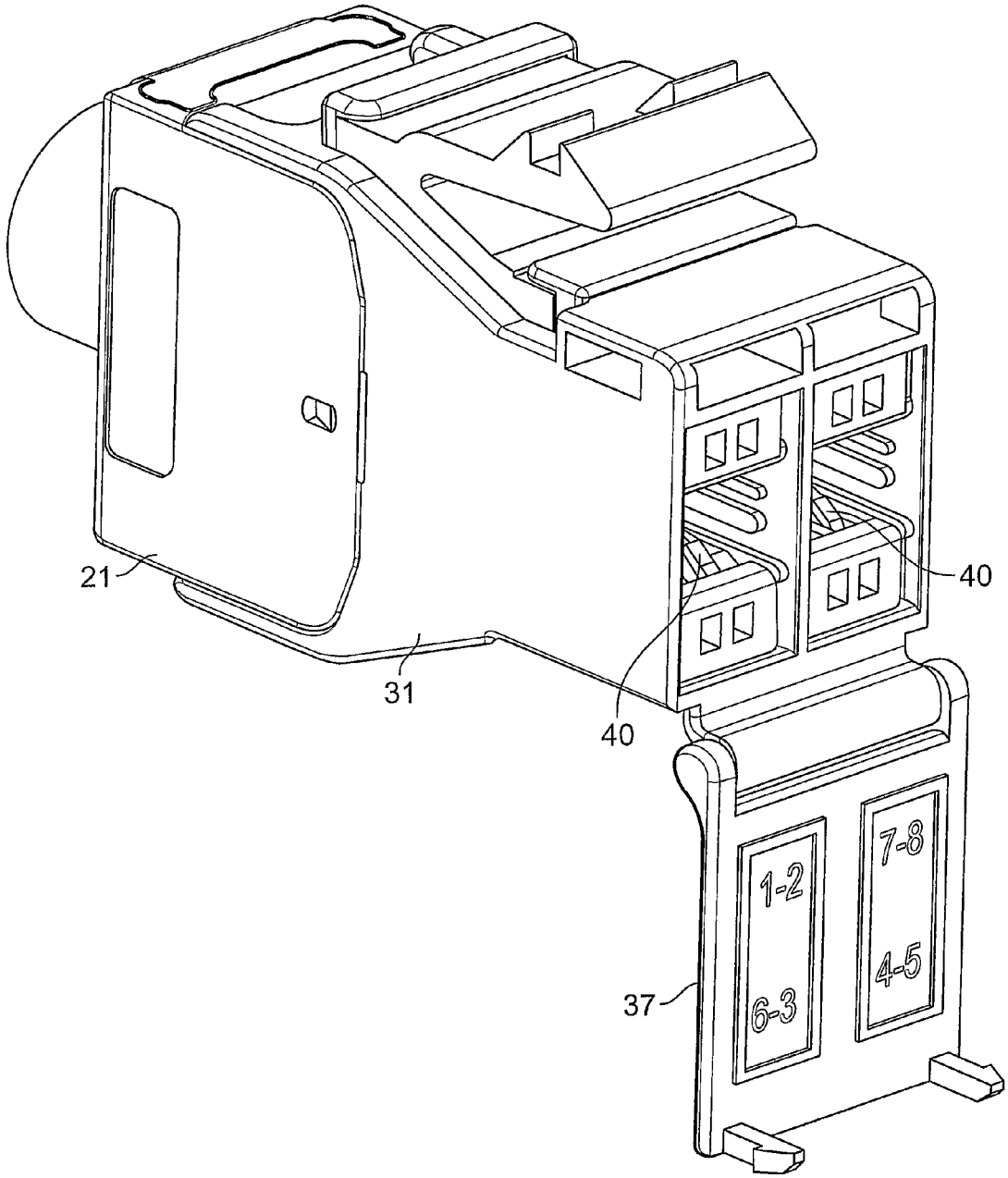
FIG. 8 is an alternative perspective view of the connector of FIG. 6.

Referring to FIG. 2, a termination assembly 30 is shown which includes a housing 31 also formed from Zamak or other metal or conductive material. Termination assembly 30 includes a number of wire receiving contacts in the form of insulation displacing contacts 32 which are mounted in pairs in contact carriers 33 which insulate them electrically from housing 31. The insulation displacing contacts are in electrical connection with connectors 40 or can be the same metal part (see FIG. 8) in housing 31 which form a part of a jack protected by dust cover 37 when used. Termination assembly further includes an upper cutting blade 34 and a lower cutting blade 74 mounted in housing 31 and each having a cutting portion in the form of cutting edges 35, 75 and a body portion being the remainder of each blade.

Cap 20 and termination assembly 30 may be assembled together to form a connector which terminates a cable. The assembly of the connector will now be described. The following description explains termination of a four twisted pair foil shielded cable. However, other types of cable may be terminated by connectors according to the invention.

Figure 3:
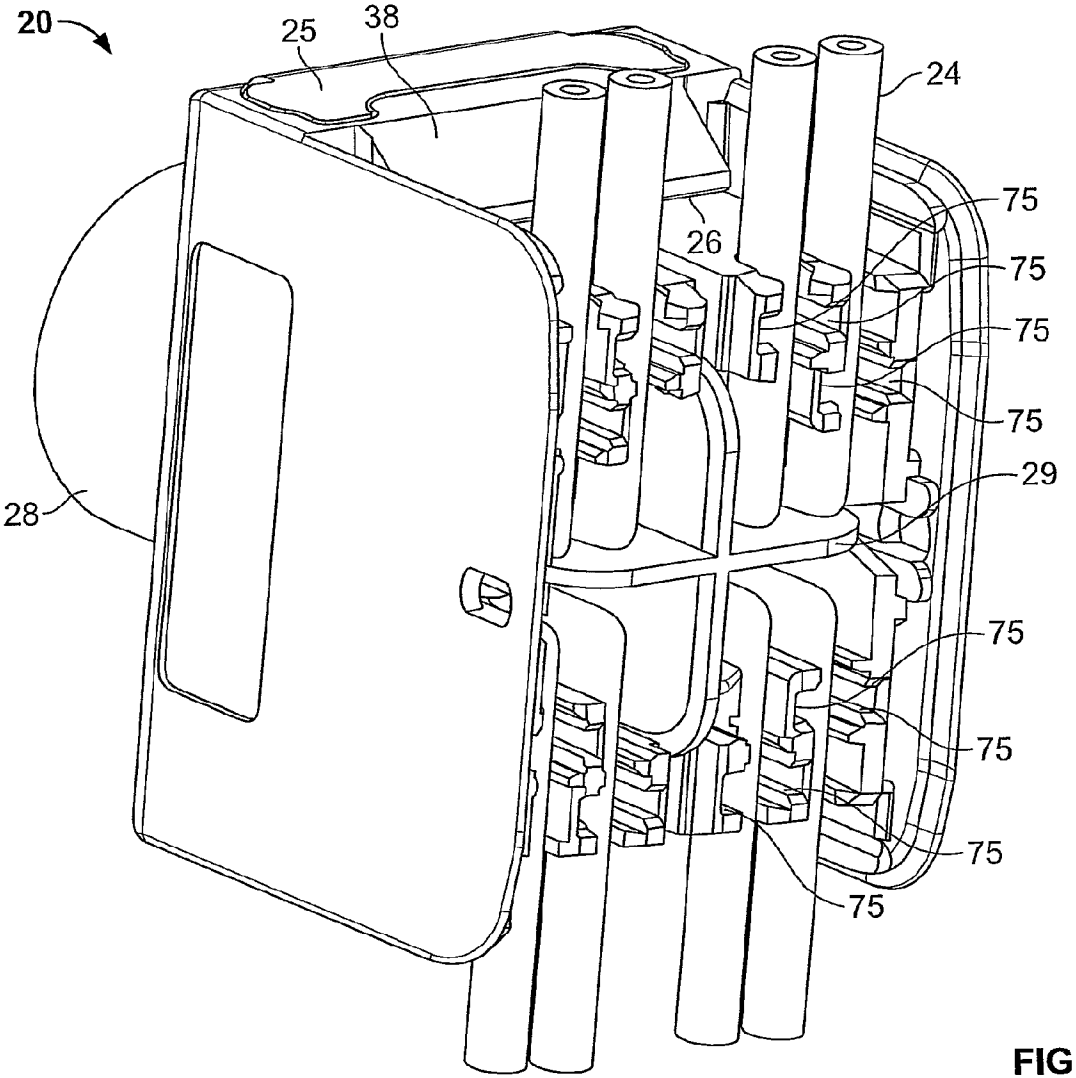
FIG. 3 is a perspective front view of the cap of FIG. 1 showing wires of a cable in the wire receiving spaces.
Figure 4:
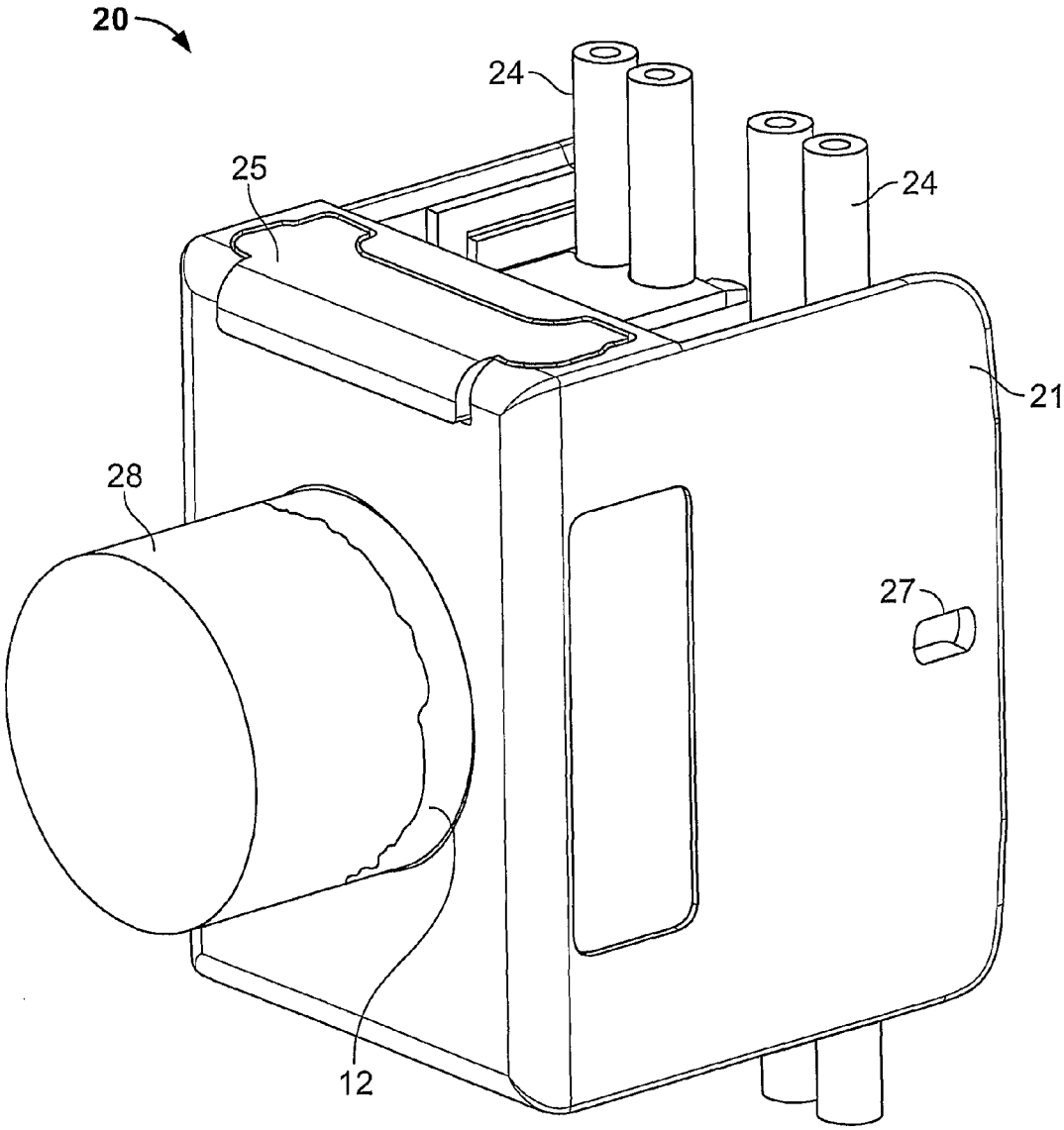
FIG. 4 is a perspective rear view of the cap of FIG. 1 showing wires of a cable.

Referring to FIGS. 1, 3 and 4, in order to terminate a cable by way of the connector the wire clamp is pushed to the open position (as shown in FIG. 4) and the end of the cable 28 is inserted through apertures 14 and 16. The end of the cable is then prepared by removing a length of the outer insulation from the end of the cable and folding back the foil shield 12 to exposing the wires 24 inside the cable. Each of the wires 24 are then pushed into their correct positions in the wire receiving spaces 23 of lacing fixture 22 (see FIGS. 1 and 3). Each wire receiving space includes a pair of guide slots 75 which are provided on opposite sides of each space 23 in pairs. The guide slots receive and guide the insulation displacing contacts during assembly of the connector.

Latches 18, of wire clamp 25 are then released and compression springs 15 bias clamp 25 to the clamping position so that the folded back portion of the foil or braid shield 12 becomes gripped by cable clamp 25 to achieve electrical continuity between the foil or braid shield and cap 20.

An internal shielding arrangement is provided inside cap 20 in the form of quadrant shield 29 (see FIG. 3) which is formed from Zamak or other conductive material and serves to shield wires in pairs in each quadrant from one another to reduce crosstalk and improve transmission performance. Recesses 26 receive the cutting edge 35 of cutting blade 34 when assembled as will be later described.

Figure 5:
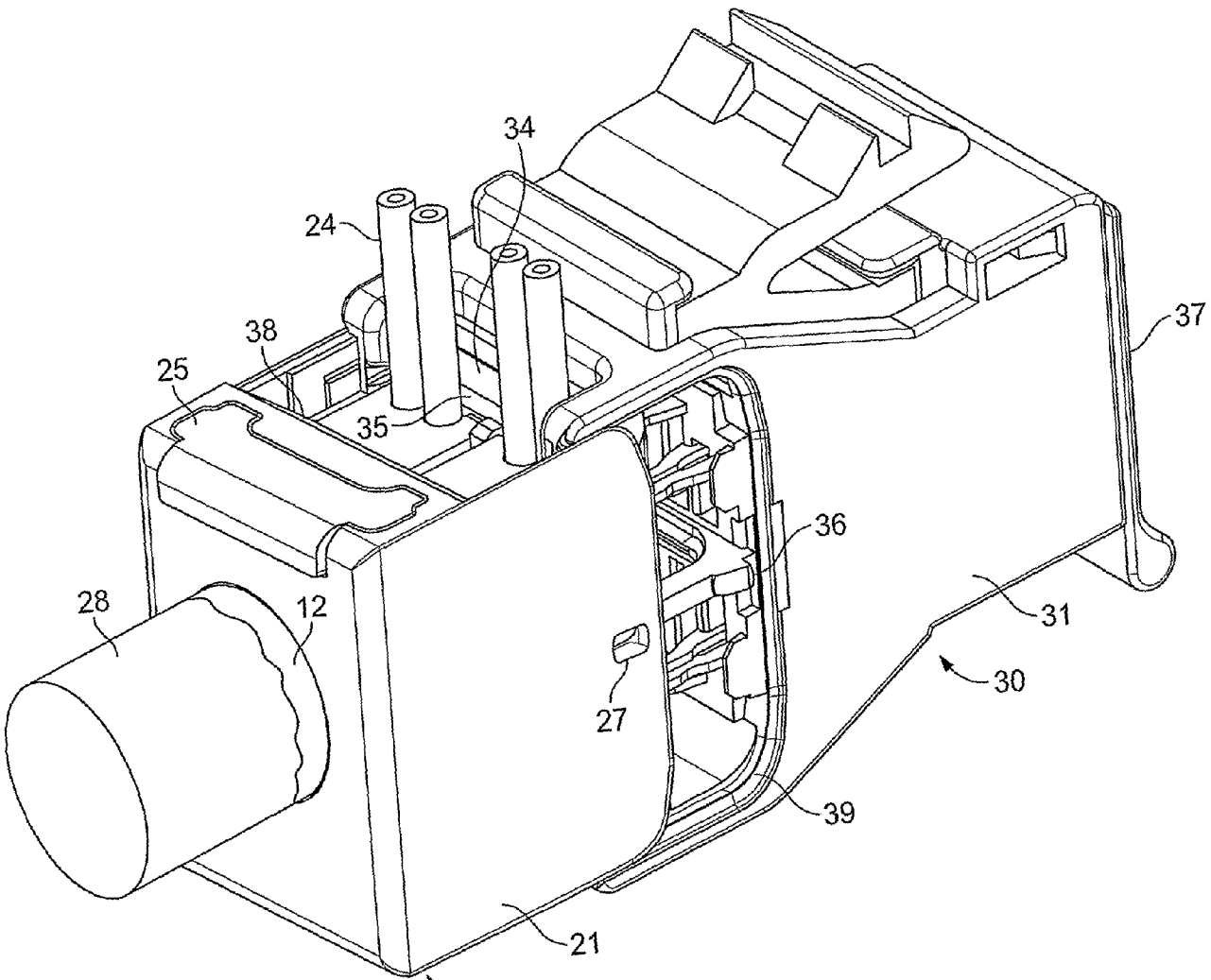
FIG. 5 is a perspective view of the cap and housing of FIGS. 1 and 2 partially assembled together to form a connector.

Cap 20 is then assembled to the termination assembly 30. Referring to FIG. 5, the cap 20 and termination assembly 30 are shown partly assembled together. It can be seen that cutting portion 35 of blade 34 is about to cut free ends of wires 24 and as cap 20 and termination assembly 30 are brought closer together the free ends become severed and are ejected from the assembly by way of angled surface 38 and cutting portions 35 of blades 34 are accommodated by recess 26. In FIG. 5, only upper blade 34 is visible as lower blade 74 is obscured in the drawing. Blade 74 operates simultaneously with blade 34 to cut the oppositely directed group of wires which are also not visible in FIG. 5. As cap 21 and housing 31 are pushed together the guide slots 75 (see FIG. 3) receive the insulation displacing contacts 32 and guide them into proper engagement with each of wires 24.

Figure 6:
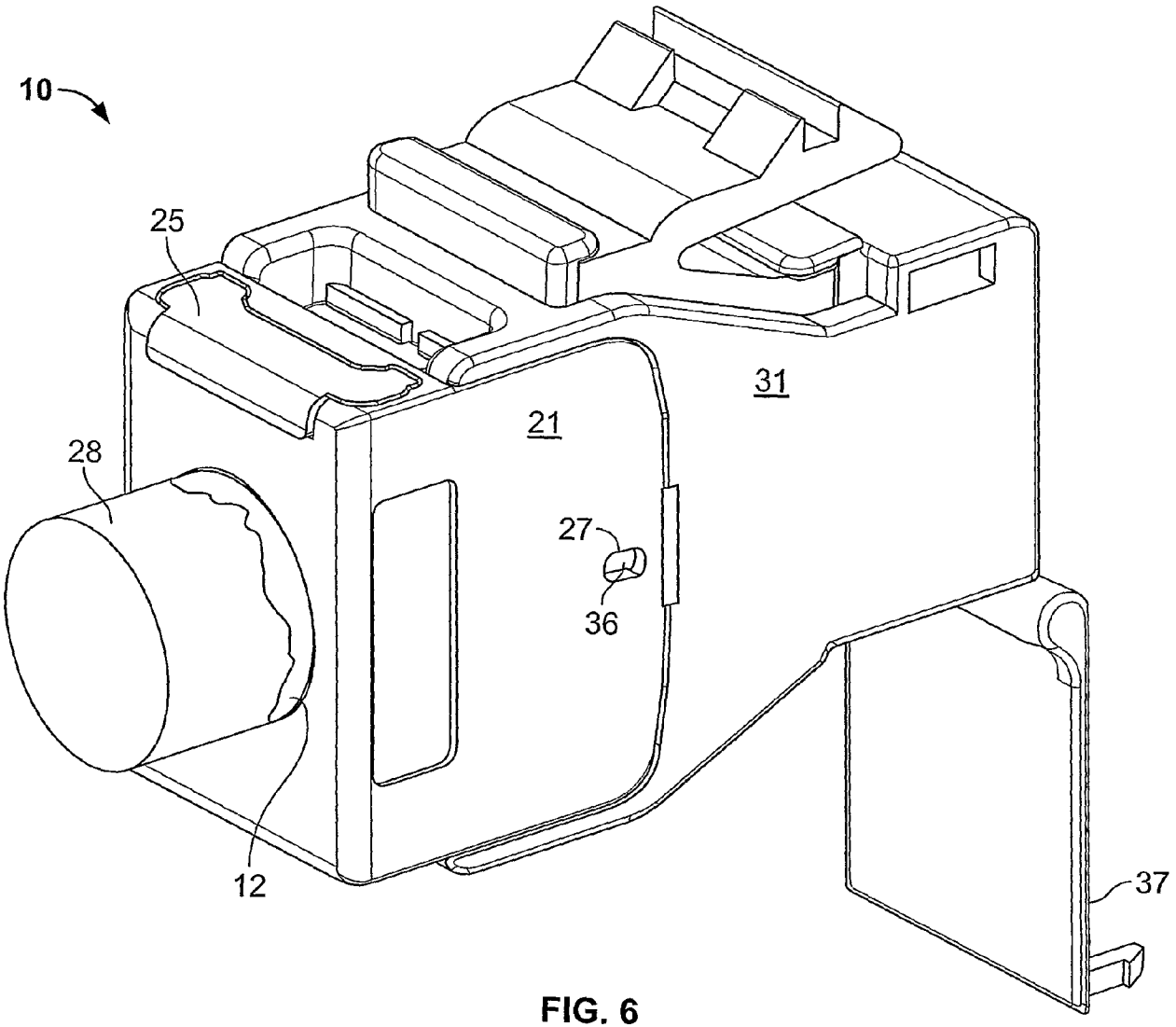
FIG. 6 is a perspective view of a fully assembled connector formed from the cap and housing of FIGS. 1 and 2 shown with dust cover open.

Referring to FIG. 6, cap 20 and termination assembly are fully assembled together to form connector 10. Latch 36 engages with aperture 27 to retain cap 20 and termination assembly 30 together. When assembled, cover 21 overlaps with housing 31 in the region of rebate 39 (see FIG. 5). This overlap ensures that the wires inside the connector are completely shielded from the outside.

Figure 7:
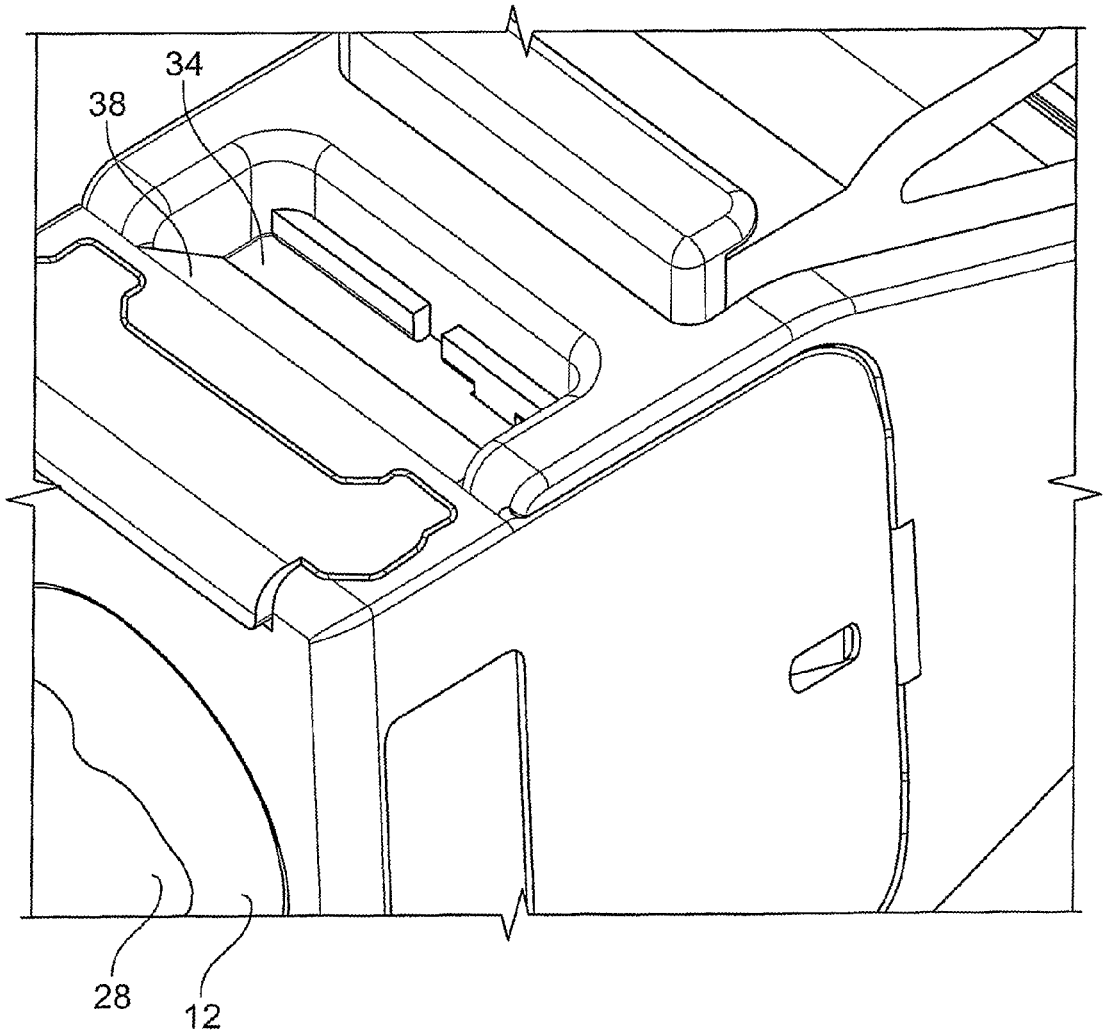
FIG. 7 is a detail view of the connector of FIG. 6.

Referring to FIG. 7, it can be seen that cutting edge 35 is now hidden as it is accommodated by recess 26. Blade 34 overlaps with both cover 21 and housing 31 to shield the wires inside the connector.

Figure 9:
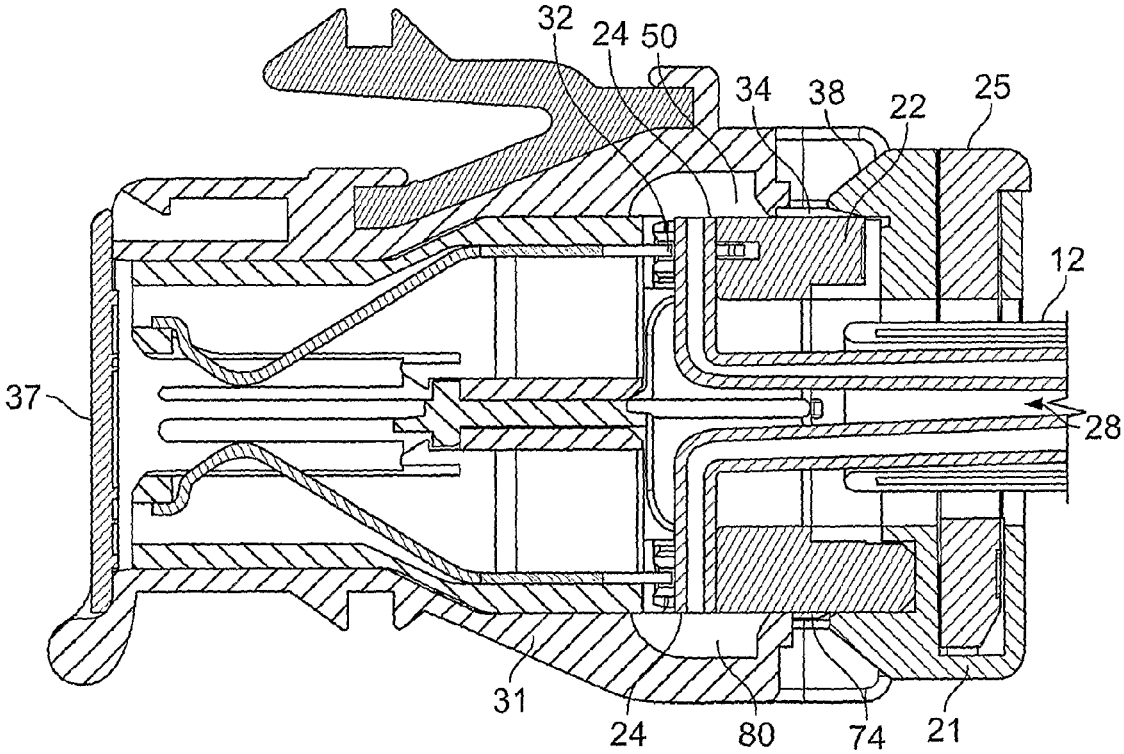
FIG. 9 is a side cross sectional view of the connector of FIG. 6.

Referring to FIG. 9, the assembled connector is shown in cross section. It can be seen that blade 34 overlaps with cover 21 and housing 31 to shield the inside of the connector. Similarly, lower blade 74 overlaps with cover 21 and housing 31 and also shields the inside of the connector. Further, it can be seen that the free ends of wires 24 have been pushed beyond blades 34, 74 during assembly. The free ends of wires 24 face into spaces 50 and 80 which avoid risk of electrical contact between wires 24 and housing 31.

In the above described embodiment the wire receiving contacts were insulation displacing contacts which disrupt insulation about a wire to achieve electrical contact. Similarly, the ends of the cable wires could be stripped prior to assembly and non-displacement type contacts could be utilised.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A connector for terminating a communications cable including:

a termination assembly including a plurality of wire receiving contacts for receiving wires of a cable;

a lacing fixture with a number of wire receiving spaces and which is used to guide the wires into engagement with the wire receiving contacts; and a cutting blade having a cutting portion and a body portion;

wherein the termination assembly and lacing fixture are arranged such that, as they are assembled together, wires held in the lacing fixture are displaced past the cutting portion of the blade and into engagement with the wire receiving contacts, which blade extends transversely to the wires and which cuts off excess wire, the body portion of the blade being located sufficiently in advance of wire-receiving contacts for the cut wires engaged with the contacts to be further displaced beyond the body portion of the blade.

2. A connector according to claim 1, wherein after assembly the blade serves to shield the wires inside the connector from external electromagnetic radiation.

3. A connector according to claim 1, wherein the connector is a jack.

4. A connector according to claim 1, wherein the wire receiving contacts are insulation displacing contacts.

5. A connector according to claim 1, wherein the lacing fixture and termination assembly each have metal bodies which overlap one another when assembled together.

6. A connector according to claim 1, further comprising a recess in the lacing fixture which receives the cutting portion of a cutting blade when the connector is assembled.

7. A connector according to claim 6, further comprising a surface which is disposed at an angle to the cutting blade to assist in ejection of cut wire ends during the assembly of the connector.

8. A connector according to claim 1, comprising at least two cutting blades.

9. A connector according to claim 8, wherein the blades are disposed on opposite sides of the connector.

10. A connector according to claim 1, comprising an internal shielding arrangement which provides shielding between pairs of wires.

11. A connector according to claim 10, which is arranged to terminate 1, 2 or 4 pairs of wires.

12. A connector according to claim 1, further comprising a cap having a recess which can accommodate the cutting portion of a cutting blade.

13. A connector according to claim 12, further comprising a surface which is disposed at an angle to assist in ejection of cut wire ends.

14. A termination assembly for use in a connector, comprising:

a plurality of wire receiving contacts for receiving wires of a communications cable, a lacing fixture with a number of wire receiving spaces and which is used to guide the wires into engagement with the wire receiving contacts; and a cutting blade having a cutting portion and a body portion, wherein the termination assembly is arranged to be assembled with the said lacing fixture such that, as they are assembled together, wires held in the lacing fixture are displaced past the cutting portion of the blade and into engagement with the wire receiving contacts, which blade extends transversely to the wires and which cuts off excess wire, the body portion of the blade being located sufficiently in advance of wire-receiving contacts for the cut wires engaged with the contacts to be further displaced beyond the body portion of the blade.

15. A termination assembly according to claim 14 which includes two cutting blades.

* * * * *